US005954271A

United States Patent [19]

Le

[11] Patent Number: 5,954,271

[45] Date of Patent: Sep. 21, 1999

[54] FLUID DRIVEN TANK CLEANING APPARATUS

[75] Inventor: Minh Quang Le, Exton, Pa.

[73] Assignee: Gamajer Cleaning Systems, Inc., Malvern, Pa.

[21] Appl. No.: 08/821,171

[22] Filed: Mar. 21, 1997

Related U.S. Application Data

[63] Continuation of application No. 08/331,121, Oct. 28, 1994, abandoned.

[51] Int. Cl.[6] ..... B05B 3/06

[52] U.S. Cl. ..... 239/227; 239/240

[58] Field of Search ..... 239/227, 240; 74/331, 337

[56] References Cited

U.S. PATENT DOCUMENTS

| | | | |
|---|---|---|---|
| 3,275,241 | 9/1966 | Saad | 239/227 |
| 3,326,468 | 6/1967 | Bristow et al. | 239/227 |
| 3,464,632 | 11/1967 | Bristow | 239/227 |
| 3,584,790 | 6/1971 | Bonfield | 239/227 |
| 3,637,138 | 1/1972 | Rucker | 239/227 |
| 3,791,583 | 2/1974 | Nunlist et al. | 239/227 |
| 3,834,625 | 9/1974 | Barthod-Malat | 239/227 |
| 3,874,594 | 4/1975 | Hatley | 239/227 |
| 3,885,740 | 5/1975 | Sugino et al. | 239/227 |
| 3,902,670 | 9/1974 | Koller et al. | 239/227 |
| 4,214,705 | 7/1980 | Watts et al. | 239/227 |
| 4,244,524 | 1/1981 | Wellings | 239/227 |
| 4,351,478 | 9/1982 | Looper | 239/227 |
| 4,353,507 | 10/1982 | Kah, Jr. | 239/240 |
| 4,501,391 | 2/1985 | Hunter | 239/97 |
| 4,708,290 | 11/1987 | Osmond | 239/227 |
| 4,798,334 | 1/1989 | Harrington | 239/227 |
| 4,842,201 | 6/1989 | Hunter | 239/396 |
| 4,867,379 | 9/1989 | Hunter | 239/240 |
| 4,967,961 | 11/1990 | Hunter | 239/240 |
| 5,012,976 | 5/1991 | Loberg | 239/227 |
| 5,092,523 | 3/1992 | Rucker et al. | 239/240 |
| 5,169,069 | 12/1992 | Rucker et al. | 239/227 |
| 5,172,710 | 12/1992 | Harrington | 134/167 R |
| 5,263,906 | 11/1993 | Antonou | 74/337 X |

OTHER PUBLICATIONS

Gamajet IV Reference Guide—Sybron Chemicals Inc./ Gamajet Equipment Division—First Edition Nov. 1992.

Sellers Cleaning Systems—ORBI–3 Masters Limited Access Tank Cleaning Challenges—Bulletin S–03–294 –1994.

Maxon Precision Motors Catalog, p. 101 (Apr., 1994).

*Primary Examiner*—Kevin Weldon

*Attorney, Agent, or Firm*—Woodcock Washburn Kurtz Mackiewicz & Norris LLP

[57] ABSTRACT

A reduced size tank cleaning machine that has an impeller rotated by an inlet stream is disclosed. The impeller turns a shaft connected to a sealed planetary gear train that causes the tank cleaning machine to rotate about an axis, and this rotation causes a set of nozzles to rotate about a second axis. The fluid from the inlet stream exists through a port located between the impeller and the gear train and through the spray nozzles. Thus, the planetary gear train drives the tank cleaning machine about a first axis and a second axis. The design disclosed is preferably constructed so that it can be inserted into an opening that is about three inches (3.00"= 76.2 mm) in diameter. Methods of cleaning vessels are also disclosed.

24 Claims, 4 Drawing Sheets

FLUID DRIVEN TANK CLEANING APPARATUS

This is a continuation of application Ser. No. 08/331,121, filed Oct. 28, 1994 abandoned.

The present invention relates to equipment for cleaning tanks using a pressurized fluid stream, and more particularly, relates to tank cleaning apparatus whereby the fluid drives a mechanism that moves a nozzles through a spray pattern.

BACKGROUND OF THE INVENTION

Fluid driven tank cleaning apparatus are well known. For example, U.S. Pat. Nos. 5,172,710; 5,169,069; 5,092,523; and 5,012,976 all relate to a line of fluid driven tank cleaning machines sold under the name GamaJet®.

It is known in the prior art to provide gear trains that convert the flow of pressurized fluid into motive power for rotating tank cleaning machines. These gear trains are typically spur gears or pinion and ring gear trains. An epicyclic nozzle drive is disclosed in U.S. Pat. No. 4,244,524—Wellings. The gear train is in the path of the input fluid stream and this fluid is used to lubricate the drive and dissipate heat. The reduction achieved by the epicyclic gear train is 156.8:1, and the disclosed device operates at pressures of about 300 psi. The Wellings patent admits that the device is simply an existing prior art nozzle (Sellers "Jumbo" Model 215 S), with the prior art harmonic drive replaced by the epicyclic gear train.

U.S. Pat. No. 3,275,241—Saad discloses a tank cleaning apparatus where the input stream rotates an impeller and then exits into the nozzle. A shaft extending from the impeller transfers its rotation into a gear box using a worm gear, and the gear box provides two axes of rotation. The gear box is sealed from the cleaning fluid flow.

Currently available apparatus, however, require a relatively large size opening for insertion into a vessel. U.S. Pat. No. 3,637,138—Rucker recognizes that the problem of providing a reduced diameter cleaning apparatus is difficult to achieve by merely reducing the size of existing components, and suggests that using planetary gear drives, such as those shown in U.S. Pat. No. 3,464,632 (Bristow) results in a device that is not reliable. Rucker also refers to U.S. Pat. No. 3,326,468, also by Bristow, which does not use a true planetary gear train, but simply uses a small pinion gear (FIG. 3, 102) to turn a ring gear (104).

U.S. Pat. No. 4,351,478—Looper recognizes that prior art cleaning devices do not fit into the relatively smaller openings of multiple compartment tank cars, and proposes as a solution a device that uses a separate air motor to turn the device. The air motor and associated equipment remain outside the vessel during cleaning, thereby permitting a reduction in the size of the cleaning head. Similarly, U.S. Pat. No. 4,214,705—Watts et al. recognizes that size reduction is desirable, and discloses a device having a separate air motor to drive part of the cleaning head. Another cleaning device uses a separate pneumatic, electric or hydraulic drive motor to rotate the cleaning head is disclosed in U.S. Pat. No. 3,834,625—Barthod-Malat. The design is said to avoid the problems caused by using high pressure fluid to drive the mechanism, i.e., the high pressure fluid causes the mechanism to rotate too quickly. A planetary gear train is used for one axis and a worn gear for the other.

On the other hand, U.S. Pat. No. 3,874,594—Hatley suggests using a single driving means, such as a turbine, powered by the washing fluid to rotate a cleaning machine about two axes. The disclosed device fits into smaller ports by connecting the nozzle and its worm drive at the end of a long shaft that is in turn connected to gearing that drives the shaft about its axis. This reference also teaches that the ratio of the rotational speeds between the axis is constant, but can be varied by a "program" determined by the profile of a cam. An alternate embodiment disclosed by the Hatley patent uses a drive mechanism for the entire cleaning head that is moved to the vicinity of the nozzle, i.e., inside the tank. The required gear reduction is achieved through a train of bevel gears, and a planetary spur gear 53 transfers the impeller rotation to a worm gear that drives one of the axes of rotation.

Finally, U.S. Pat. No. 3,88,740—Sugino et al. recognizes the need for washing apparatus of reduced size that fits through smaller access opening and the problems that arise when such mechanisms spin a too high a rate. The disclosed device, however, uses the reaction forces of the cleaning fluid exiting the nozzles to rotate the nozzle head, which in turn rotates a trochoid pump to provide a gear reduction to rotate the body of the device. Thus, in contradistinction to many other prior art devices, the cleaning fluid does not drive an impeller.

From the foregoing, it is clear that there is a long-felt need for reliable mechanisms that can provide sufficient gear reduction in rotary spray cleaning heads. Certain prior art references disclose limited uses of planetary gears, and the Bristow patent teaches that such gear trains are unreliable. The Sellers reference discloses a planetary gear drive, but teaches that it is important to flow the cleaning fluid around the components in order to provide lubrication and heat dissipation. For this reason, the planetary gear drive disclosed in Sellers is disposed between the impeller and the outlet to the nozzles.

Additionally, the prior art recognizes and offers various solutions for the problem of providing a spray cleaning head that can fit into openings of reduced size. Many of the references suggest using remote drives or separate motors that are not located in the vicinity of, or part of, the cleaning head, or that do not use the cleaning fluid as a source of motive power. The prior art further recognizes that this problem is difficult to solve, since existing devices cannot simply be scaled down to size.

SUMMARY OF THE INVENTION

The tank cleaning machine of the present invention is designed to permit the high pressure washing of containers such as Intermediate Bulk Carriers (IBC's) that have an access port that is about three inches across (3.00"=76.2 mm). The device provides a set of nozzles, preferably two or three, that rotate about a first axis and are attached to a rotating body that rotates about a second axis generally orthogonal to the first axis; the rate of rotation of the device about these axes can be varied depending upon the gear drive ratios. The device operates by providing an impeller that is impinged upon by an inlet flow stream. The flow steam then exists through the spray nozzles. The impeller rotates a shaft that is axially connected to a planetary gear train that provides a gear reduction, preferably in the range of about 236:1. The planetary gear train rotates output shafts connected to a pinion and ring gear train, and a bevel gear train driven by the rotation of the housing that has an axis of rotation offset from the axis of the impeller and planetary gear drive. These secondary drives provide the two axis rotation described above and to provide a total gear reduction of about 965:1.

The present invention effectively utilizes an inlet stream of pressurized fluid of up to 600 psi and creates an effective spray patterns using a flow rate as low as 5 GPM. The preferred range of operation is from 50–600 psi and 5–50 gpm. In addition to the compact design permitting the tank cleaning machine of the present invention to be inserted into openings as small as three inches, because the flow stream impinges upon the impeller and then exits, the gear trains are relatively isolated from the cleaning fluid stream making it easier to prevent the cleaning fluid from being contaminated by lubricating fluid required by the gearing.

DETAILED DESCRIPTION OF THE PREFERRED EMBODIMENTS

Figure 1:
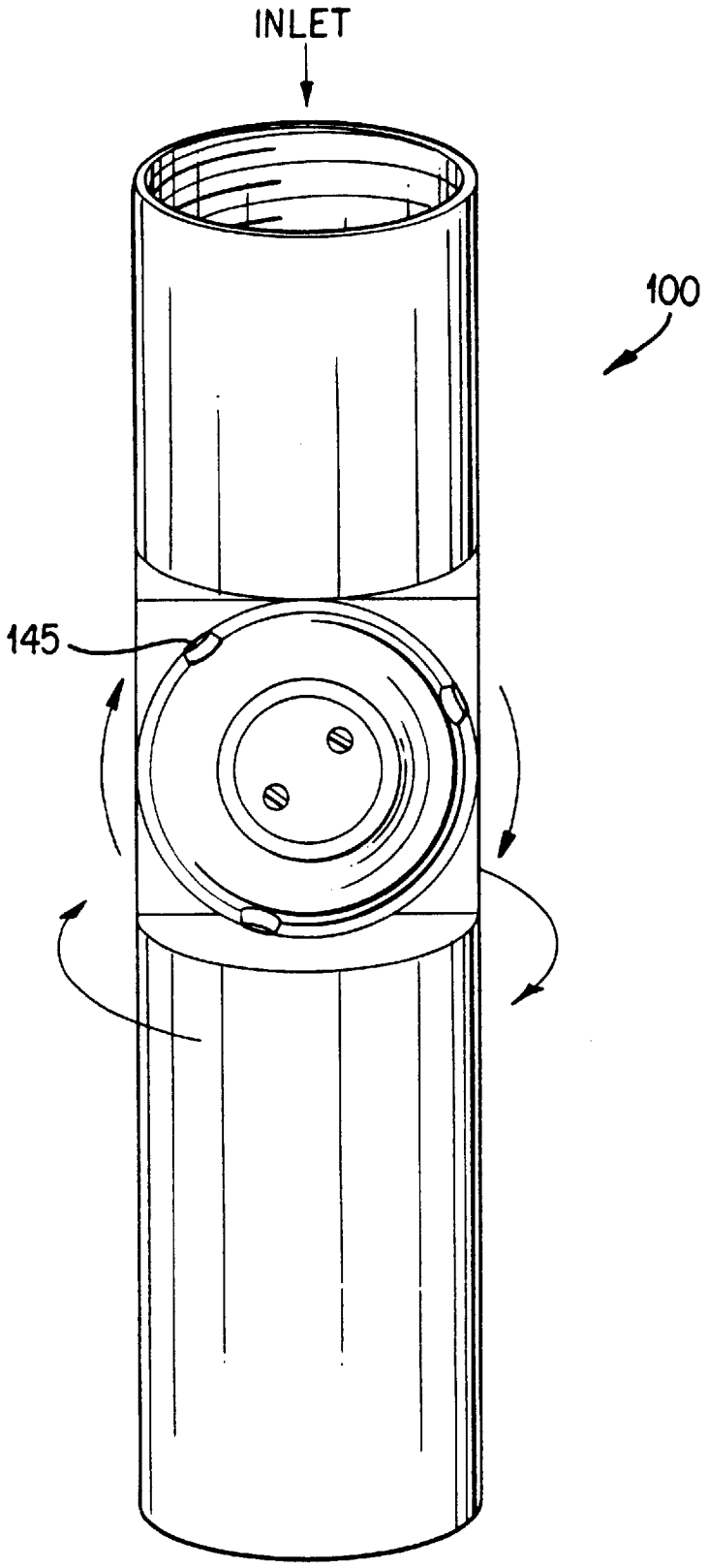
FIG. 1 is a perspective view of a tank cleaning machine made in accordance with the present invention.

A tank cleaning machine 100 made in accordance with the present invention is seen in FIG. 1, and as illustrated is preferably a generally cylindrical assembly that rotates about two axes, shown by the two sets of arrows in FIG. 1. The tank cleaning machine 100 is connected, preferably by a threaded connection, to an inlet of pressurized fluid (as indicated but not illustrated). The pressurized fluid drives the tank cleaning machine about the two axes rotation and then exits through one or more nozzles 145 to create a spray pattern of solvent or other fluid useful for cleaning or rinsing the interior of a vessel. Unlike prior art devices, the size of the assembly 100 is preferably such that it can be inserted into an opening approximately three inches (3.00"=76.2 mm) in diameter. As explained in further detail below, this improvement is achieved using a unique combination of gear trains, all of which are contained inside the tank cleaning machine assembly 100 illustrated in FIG. 1. However, it will be understood that although a preferred embodiment of the present invention is of such a reduced size, it will be in some instances desirable to enlarge the size of one or more components or the entire assembly 100 if an opening of a slightly larger size is available in a particular application. Generally, however, those of skill in the art will appreciate that smaller diameter equipment is preferred in nearly all applications so long as the spray pattern is of sufficient velocity, pressure and distribution to effectively clean the interior of the tank or other vessel.

Figure 2:
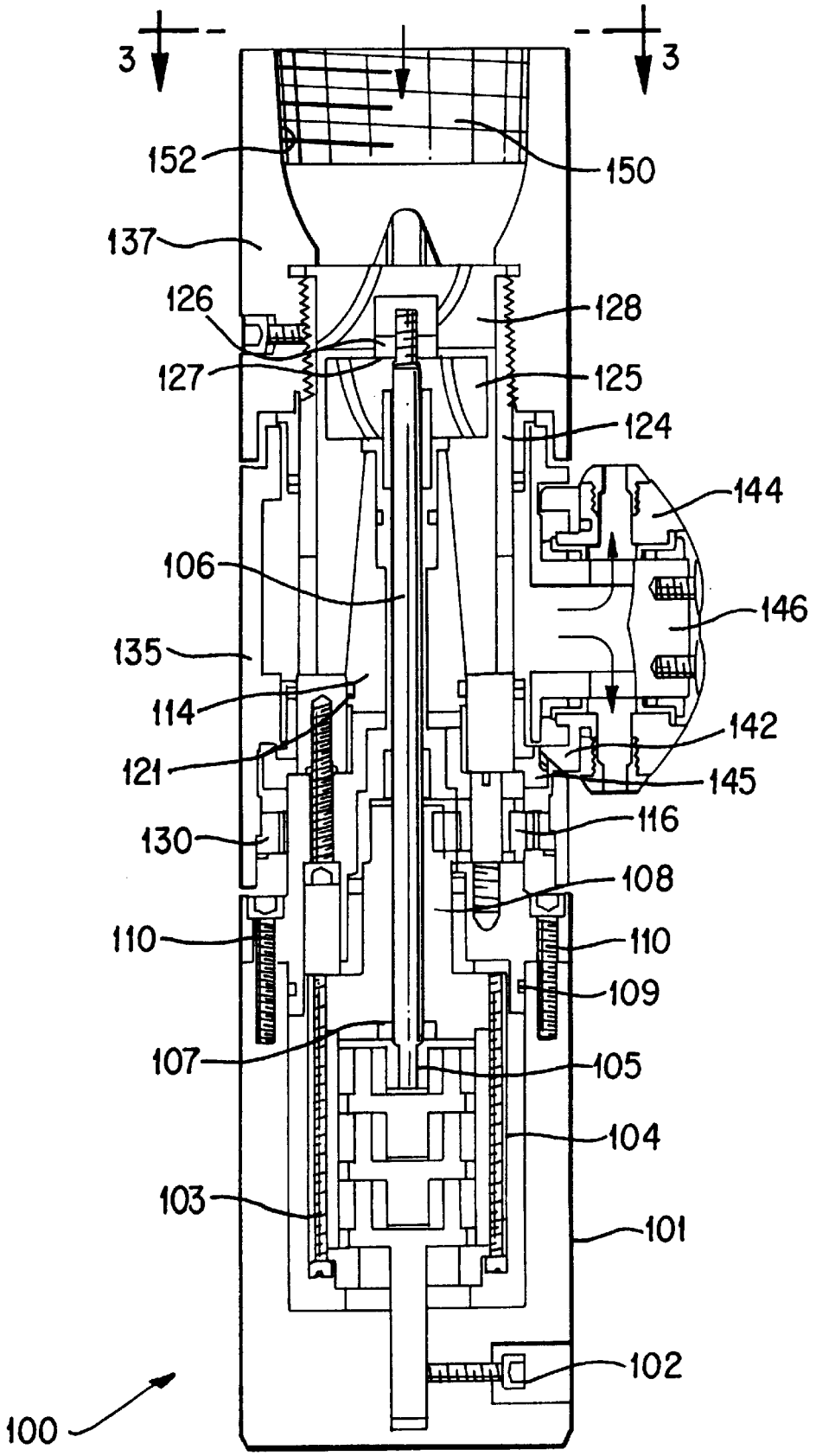
FIG. 2 is a longitudinal cross-sectional view of the tank cleaning machine illustrated in FIG. 1.

Referring now to FIG. 2, a cross-sectional view of the tank cleaning machine 100 seen in FIG. 1 is illustrated. A gearbox 101 contains a planetary gear drive 104, which is held in place using a retainer screw 102 that is tightened against a shaft extending from the planetary gear drive 104. The gearbox 101 is most preferably substantially cylindrical and is machined from a single piece of material, such as 316L stainless steel, reducing the likelihood that fluids will leak into the interior and thus into the planetary gear drive 104. An input pinion 105 is affixed to an input shaft 106, the rotation of which drives the planetary gear train 104. Surrounding the input shaft 106 is an output pinion 108 that, in the preferred embodiment illustrated, is integrally formed with a portion of the cover of the planetary gear drive 104, and is attached to the body of the planetary gear derive 104 by a screws 103. In other words, the input shaft 106 passes through and is free to rotate relative to the planetary gear train 104. The output pinion 108 most preferably has 11 teeth and is formed from a heat-tempered stainless steel, such as 17-4 PH HT-H900. A fluid-tight joint between the output pinion 108 and the input shaft is formed using a seal 107, preferably comprised of 301 stainless steel and fluoroloy 33.

The gearbox 101 and the associated components are attached by set screws 110 to a gearbox nose 114, which is also preferably comprised of 316L stainless steel. The joint between the gearbox 101 and the gearbox nose 114 is sealed by an O-ring 109, which in the embodiment shown is a 1.5×0.070 Viton 884-75 (2-027). The details of the gearbox nose 114 are explained in further detail below, however, it can be seen in FIG. 2 that the gearbox nose 114 surrounds the input shaft 106 and also provides support for idler gears 116, the function of which is also explained below. Most preferably, the idler gears 116 have 17 teeth.

A stem 124 provides a housing that surrounds the gearbox nose 114, and is preferably constructed of stainless steel and is threaded at one end to accept the remaining sections of the housing; an O-ring 121 provides a seal between the stem 124 and the gearbox nose 114. The stem 124 is designed to provide a close fit with the rotor 125, which is attached to the input shaft 106 by a nut 127 and locking washer 126. The rotor 125 rotates when an incoming stream of pressurized fluid impinges upon its vanes, and its rotation in turn rotates the input shaft 106 and, ultimately, provides the input power to the planetary gear train 104.

A tee housing 135 fits over and surrounds the stem 124. As seen in FIG. 1, it is preferred that the outside diameter of the tee housing 135 is generally the same as the diameter of the gearbox 101 so that when assembled, a cylindrical envelope is presented. As with the other components discussed above, it is preferable to construct the tee housing 135 from stainless steel. As discussed below, a ring gear 130 is mounted within and attached to the tee housing 135. The ring gear 130 is driven by the idler gears 116, causing the tee housing 135 to rotate relative to the stem 124 and the rest of the assembly 100. In a most preferred embodiment, the ring gear has 45 teeth.

The tee housing 135 further includes a section that contains the nozzle housing 144 and the associated components that cause it to rotate in an axis displaced from the axis of rotation of the tee housing 135. In the preferred embodiment illustrated, this axis of rotation is substantially orthogonal to the axis of rotation of the tee housing 135. As explained above with reference to other components, the joints between the tee housing and the other components of the assembly 100 are kept fluid tight using appropriate seals, O-rings and fittings.

The details of the connection between the nozzle housing 144 and the tee housing 135 are also shown in FIG. 2. A nozzle housing bevel gear 142 converts the rotation of the tee housing 135 around a first axis to rotation to rotation about a second axis that is most preferably orthogonal to the first axis. The ring gear 130 is fixed relative to the tee housing 135, and a tee housing bevel gear 145 meshes with and rotates the nozzle housing bevel gear 142 and the nozzle housing 144 affixed to it. The nozzle housing bevel gear 145 is fixed relative to the stem 124 and the rotation of the tee housing cases 135 it to rotate and mesh with the nozzle housing bevel gear 142. The nozzle housing 144 is affixed to the tee housing 135 by a cover plate 146 held in place by screws 147. The portion of the tee housing 135 that extends to join with the cover plate 146 is hollow and directs fluid to the nozzles 145. The cover plate 146 thus acts as a hub and the tee housing 135 acts as an axle upon which the nozzle housing 144 rotates.

Still referring to FIG. 2, an inlet stem collar 137 is screwed to the stem 124 and abuts the tee housing 135, thereby creating a complete assembly along a longitudinal axis. The inlet stem collar 137 preferably includes a nozzle portion 150 shaped to properly channel the inlet flow. A threaded section 152 couples the inlet stem collar, an thus the entire assembly to an inlet of pressurized fluid (not shown). The threaded section 152 is most preferably a 1.25 NPT female inlet connection. The inlet stem collar 137 also provides a position for the stator 128 which is positioned in the flow path at the apex of the nozzle 150 and immediately upstream from the rotor 125. The stator 128 is held in place by a groove cut in the inlet stem collar 137 that overlies the outer extremities of the stator 128.

Figure 3:
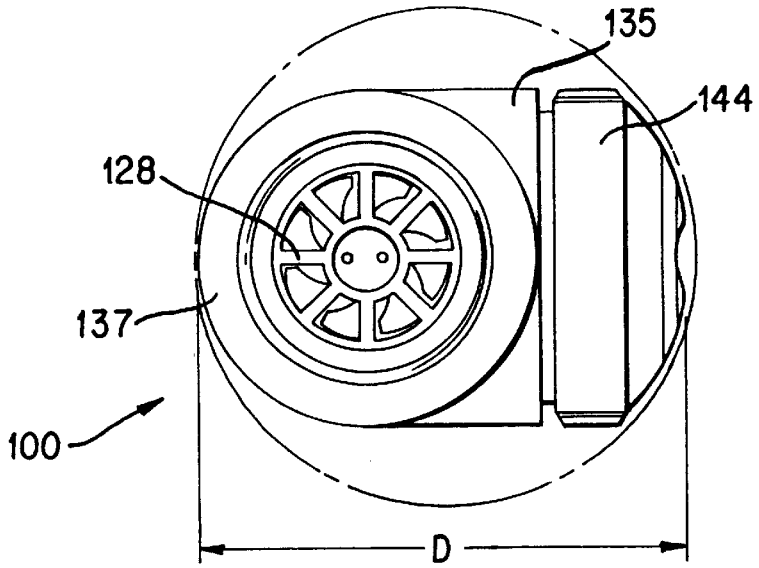
FIG. 3 is a top view of the tank cleaning machine depicted in FIG. 1.

Referring now to FIG. 3, a top view of the tank cleaning machine 100 illustrated in FIGS. 1–2 is shown. In this view, the stator 128 is visible. A circle of diameter "D" circumscribes the assembly and thus defines the minimum diameter circular opening through which the assembly 100 can be passed. In accordance with a most preferred embodiment of the present invention, the diameter of this circle is about three inches (3.00"=7.62 mm). It can be seen in FIG. 3 that this requirement means that the body diameter of the inlet stem collar 137, the tee housing 135 and the gearbox 101 (not visible in this view) must be somewhat smaller than this dimension in order to accommodate the nozzle housing 144 that extends from the tee housing 135. In the preferred embodiment illustrated, the body diameter of the assembly is a maximum of about 2.063 inches (52.4 mm).

Figure 4:
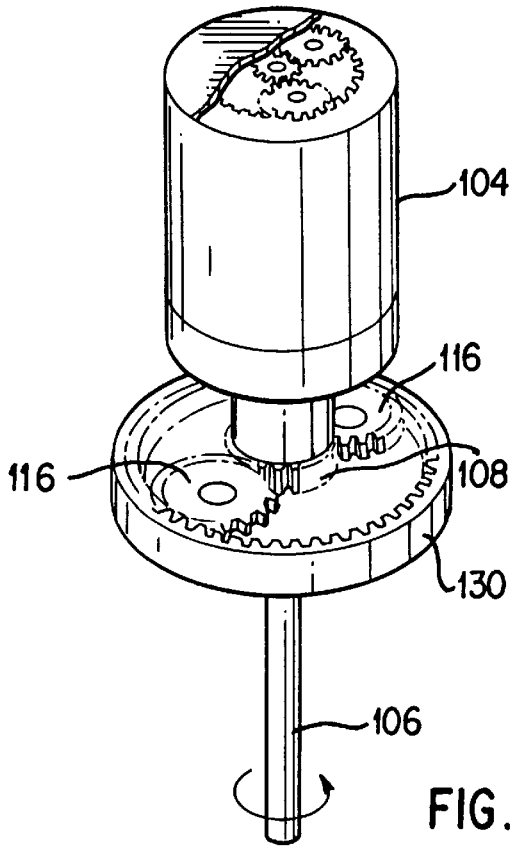
FIG. 4 is a perspective view of the components of a gear train preferably used in accordance with the present invention.

Referring now to FIG. 4, further details of the gear train used with preferred embodiments of the present invention are illustrated. In this view, the other components of the assembly 100 described above and shown in FIGS. 1–3 have been removed for clarity. As shown, the planetary gear drive 104 is most preferably a sealed unit that is attached to a output pinion 108 that is affixed to a portion of the housing that surrounds the sealed planetary gear drive 104. As explained above, an input shaft 106 that is rotated by the rotor (not shown) passes through the output pinion 108 and drives the planetary gear drive 104. As the output pinion rotates, it drives two idler gears 116 that ride inside the ring gear 130, as explained above.

The planetary gear train most preferably provides a gear reduction, in the range of 236:1. These gear reduction provided by the rest of the gear train is preferably chosen provide a total gear reduction of 965:1. This large gear reduction is important because it permits higher pressure inlet streams to be used. Since increases in pressure increase the speed of the impeller, a large gear reduction is necessary or the device will spin about its axes at such a high rate that a "cloud" of mist is created that is ineffective for cleaning. However, those of ordinary skill will realize that the selection of a particular gear ratio will depend somewhat upon the pressure and flow rate of the inlet stream of pressurized fluid, as well as being dependent upon the type of cleaning fluid and the cleaning requirements of a particular tank or vessel.

The tank cleaning machine of the present invention preferably operates within a pressure range between 50–450 psi, and at flow rates between 5–50 gpm. The device can be fitted with either two or three spray nozzles, as desired. Using two nozzles with orifices of 0.187 inches, a flow rate of 10 gpm is obtained at 100 psi, 13.5 gpm at 150 psi and 20.3 gpm at 300 psi. If three nozzles with orifices of 0.150 inches are used, a flow rate of 10 gpm is obtained at 100 psi, 13.5 gpm at 150 psi and 20 gpm at 300 psi. Using either nozzle configuration, the cycle times are 13 minutes at 100 psi, 10 minutes at 150 psi and 6.5 minutes at 300 psi.

Figure 5:
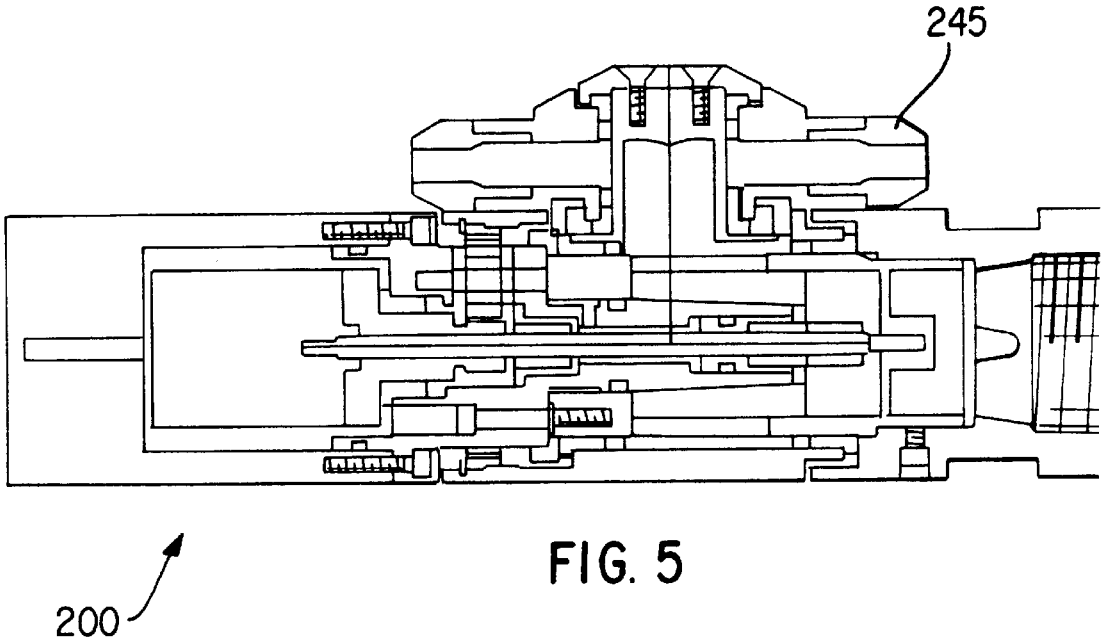
FIG. 5 is a cross-sectional view, similar to FIG. 2, of an alternative embodiment of a tank cleaning machine made in accordance with the present invention.
Figure 6:
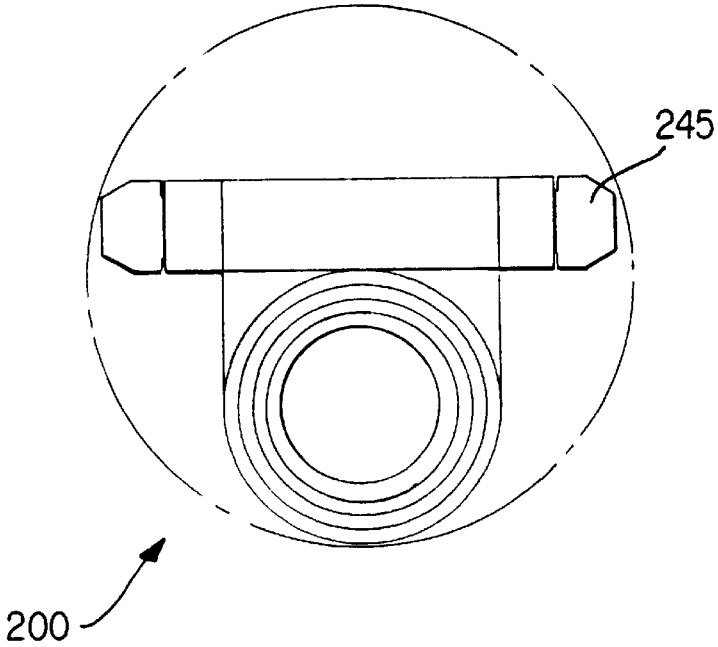
FIG. 6 top view, similar to FIG. 3, of the tank cleaning machine depicted in FIG. 5.

Referring now to FIGS. 5–6, an alternate embodiment of a tank cleaning machine 200 is illustrated. In this embodiment, the diameter of the body of the machine is further reduced and thus permits longer nozzles 245 to be used. As seen in FIG. 6, even with the longer nozzles, the tank cleaning machine 200 will still fit in a three inch opening. As readily appreciated by those of skill in the art, using extended nozzles 245 permits a wider variety of spray patterns to be achieved, as well as providing enhanced performance at certain pressure levels, certain flow rates and with certain types of cleaning fluids.

In any embodiment, the tank cleaning machines described above provide several advantages over the prior art. First, they will operate effectively at a low flow rate and high pressure, permitting cleaning fluid to be economized. Additionally, unlike certain prior art devices, including some described above, the tank cleaning machines made in accordance with he present invention do not have oil in the gearbox, which is sealed. This precludes contaminating the cleaning fluid with oil, and also precludes cleansing the lubricant from within the gearbox. The use of a sealed, lubricated planetary gear train, along with other high precision gear trains reduces friction and heat and also increases the efficiency of the operation of the tank cleaning machine. Additionally the design reduces wear and maintenance.

Finally, the ability of a tank cleaning machine made in accordance with the present invention to be passed through an small opening is a significant advance, since many vessels include clean out ports, filler and drain plugs, or other types of openings that are much smaller than the minimum opening required for known tank cleaning machines. Currently, tank cleaning machines such as those discussed above are mounted in larger openings, which are typically fewer in number. As a result, the effectiveness of the spray patterns is not always fully utilized, and certain areas that are remote from the spray head require longer cleaning times until effectively cleaned. This slows down the cleaning operation and is a major drawback where a large number of containers or tanks need to be cleaned. Thus, the present invention permits a greater number of tank cleaning machines to be inserted into typical tanks, and the overall cleaning time is reduced, while the effectiveness of the cleaning operation is typically enhanced.

Thus, the present invention also discloses improved methods of cleaning closed vessels comprising inserting one or more tank cleaning machines into small, existing openings in the vessel, and forcing pressurized fluid through the tank cleaning machines. Preferably, the opening used are spaced around the surface of the vessel and are smaller than the minimum opening required for prior art tank cleaning machines, and can be as small as about three inches.

Although certain embodiments of the present invention have been described with particularity, it should be understood that this description was provided for purposes of illustrating the invention, and were not meant to in any way limit the invention. Upon review of the foregoing specification, those of ordinary skill will immediately realize that there are numerous variations, adaptations and modifications that readily present themselves. These alternate embodiments, however, will not have significantly departed from the concepts disclosed herein and will therefore still incorporate the present invention. Accordingly, reference should be made to the appended claims in order to ascertain the full scope of the present invention.

What is claimed is:

1. A tank cleaning machine comprising a rotor rotated by an inlet stream, wherein an impeller turns an input shaft connected to a planetary gear train and a secondary gear train, and wherein the inlet stream exits through a port and into a rotary spray nozzle, whereby the planetary gear train rotates the tank cleaning machine about a first axis and the secondary gear train rotates the rotary spray nozzle about a second axis, and wherein the cleaning machine has a maximum outside diameter of less than about three inches, the planetary gear train comprising:

(i) a first pinion gear connected to said input shaft and defining a central axis thereof, (ii) a rotatable cylindrical ring gear mounted for rotation about said central axis, said cylindrical ring gear having gear teeth formed on the interior surface thereof, (iii) first, second and third stages of gears rotating within said rotatable cylindrical ring gear and engaging said internal ring gear teeth, said first and second gear stages comprising first and second planetary gears defining first and second planetary gear axes, respectively, about which said planetary gears rotate, said first and second planetary gears mounted so that said first and second planetary gear axes rotate about said first pinion central axis, said third gear stage comprising a stationary gear, (iv) a second pinion gear connected to said first and second gear stages, (v) a third pinion gear connected to said second and third gear stages, and wherein said first pinion gear drives said first planetary gear, said first planetary gear drives said second pinion gear, said second pinion gear drives said second planetary gear, said second planetary gear drives said third pinion gear, said third pinion gear drives said stationary gear, said stationary gear drives said cylindrical ring gear, and said cylindrical ring gear drives said rotation of said tank cleaning machine about said first axis and drives said secondary gear train so as to rotate said rotary spray nozzle about said second axis.

2. The tank cleaning machine of claim 1 wherein the port is located between the impeller and the gear train.

3. The tank cleaning machine of claim 1, wherein the port is disposed within a tee housing.

4. The tank cleaning machine of claim 3, further comprising a ring gear affixed to the tee housing, wherein the ring gear engages a pinion gear driven by the planetary gear train.

5. The tank cleaning machine of claim 3, further comprising a nozzle housing rotatably mounted to the tee housing.

6. The tank cleaning machine of claim 5, wherein the nozzle housing further comprises a first bevel gear driven by a second bevel gear affixed to the stem, wherein the nozzle housing is driven around the second axis by the first bevel gear.

7. The tank cleaning machine of claim 1, further comprising a stator disposed between the inlet and the rotor.

8. The tank cleaning apparatus of claim 1, further comprising a housing surrounding rotor, the input shaft the planetary gear train are surrounded by a housing.

9. The tank cleaning apparatus of claim 8, wherein the planetary gear box comprises a sealed assembly disposed within the housing.

10. The tank cleaning machine according to claim 1, wherein said first axis about which said tank cleaning machine rotates coincides with said central axis defined by said first pinion gear and about which said rotatable cylindrical ring gear and said first and second planetary gear axes rotate.

11. The tank cleaning machine according to claim 10, wherein said rotatable cylindrical ring gear is a first ring gear, and further comprising:

a fourth pinion gear coupled to said first ring gear, said fourth pinion gear mounted for rotation about said central axis; and a second ring gear driven by said fourth pinion gear, said second ring gear mounted for rotation about said central axis, said second ring gear driving said rotation of said tank cleaning machine about said first axis.

12. Apparatus for cleaning the interior of a vessel, comprising:

a planetary gear drive connected to an input shaft enclosed by a stem, the planetary gear drive comprising:

(i) a first pinion gear connected to said input shaft and defining a central axis thereof, (ii) a rotatable cylindrical ring gear mounted for rotation about said central axis and having gear teeth formed on an interior surface thereof, (iii) first, second and third stages of gears rotating within said rotatable cylindrical ring gear and engaging said ring gear internal teeth, said first and second gear stages comprising first and second planetary gears defining first and second axes, respectively, about which said planetary gears rotate, said first and second planetary gears mounted so that said first and second planetary gear axes rotate about said first pinion central axis, said third gear stage comprising a stationary gear, (iv) a second pinion gear connected to said first and second gear stages, (v) a third pinion gear connected to said second and third gear stages, and wherein said first pinion gear drives said first planetary gear, said first planetary gear drives said second pinion gear, said second pinion gear drives said second planetary gear, said second planetary gear drives said third pinion gear, said third pinion gear drives said stationary gear, said stationary gear drives said cylindrical ring gear;

an output pinion driven by said cylindrical ring gear of the planetary gear drive;

a gearbox nose surrounding the input shaft and also supporting an idler gear driven by the output pinion;

a rotor mounted within the gearbox nose and attached to the input shaft, wherein the rotor rotates when an incoming stream of pressurized fluid impinges upon the rotor, and in turn rotates the input shaft to provide the input power to the planetary gear drive;

a tee housing surrounding the stem and having a second ring gear mounted therein, driven by the idler gear, whereby the tee housing rotates relative to the stem;

a nozzle housing rotatably mounted on the tee housing that rotates about an axis displaced from the axis of rotation of the tee housing;

a nozzle housing bevel gear mounted in the tee housing for converting the rotation of the tee housing about the first axis to the rotation of the nozzle housing about a second axis, the rotation of the tee housing causes the rotation of the bevel gear and the nozzle housing affixed to the bevel gear; and an inlet stem collar comprising a nozzle portion shaped to channel the inlet flow, and wherein the apparatus has a maximum outside diameter of less than about three inches.

13. The apparatus of claim 12 further comprising a stem surrounding the gearbox nose.

14. The apparatus of claim 12 wherein the tee housing further comprises an opening through which fluid is directed.

15. The apparatus of claim 12 wherein the nozzle housing further comprises two nozzles.

16. The apparatus of claim 12 wherein the nozzle housing further comprises three nozzles.

17. The apparatus of claim 12 wherein an inlet stem collar further comprises a threaded section that couples the inlet stem collar to an inlet of pressurized fluid.

18. The apparatus of claim 12 further comprising a stator positioned in the flow path of the pressurized fluid disposed in the nozzle immediately upstream from the rotor and held in place by a groove cut in the inlet stem collar.

19. A method of cleaning closed vessels comprising the steps of:

inserting one or more tank cleaning machines into openings in the vessel, the maximum outside diameter of the tank cleaning machine being less than about three inches;

forcing pressurized fluid through the tank cleaning machines to rotate a rotor; and driving a planetary gear box and a secondary gear train within the tank machines using the rotor, the planetary gear box comprising (i) a first pinion gear connected to said rotor and defining a central axis thereof, (ii) first, second and third stages of gears rotating within a cylindrical ring gear, said first and second gear stages comprising first and second planetary gears defining first and second axes, respectively; about which said planetary gears rotate, said first and second planetary gears mounted so that said first and second planetary gear axes rotate about said first pinion central axis, said third gear stage comprising a stationary gear, (iii) a second pinion gear connected to said first and second gear stages, (iv) a third pinion gear connected to said second and third gear stages, and wherein the step of driving said planetary gear box further comprises the steps of using said first pinion gear to drive said first planetary gear, using said first planetary gear to drive said second pinion gear, using said second pinion gear to drive said second planetary gear, using said second planetary gear to drive said third pinion gear, using said third pinion gear to drive said stationary gear, using said stationary gear to drive said cylindrical ring gear, using said cylindrical ring gear to drive said secondary gear train.

20. An apparatus for cleaning the interior of a vessel by ejecting a rotating stream of pressurized fluid, comprising:

an inlet for receiving said fluid under pressure;

a rotatable nozzle having a passage for ejecting said pressurized fluid received by said inlet, said rotatable nozzle mounted for rotation about a central axis;

an impeller connected to an input shaft;

means for directing said pressurized fluid from said inlet to said impeller, whereby said fluid causes rotation of said impeller and said input shaft;

a planetary gear train for rotating said nozzle comprising:

(i) a first pinion gear connected to said input shaft, (ii) a rotatable cylindrical ring gear mounted for rotation about said central axis and having gear teeth formed on an internal surface thereof, (iii) first, second and third stages of gears rotating within said rotating cylindrical ring gear and engaging said ring gear internal teeth, said first and second gear stages comprising first and second planetary gears defining first and second axes, respectively, about which said planetary gears rotate, said first and second planetary gears mounted so that said first and second planetary gear axes rotate about said central axis, said third gear stage comprising a stationary gear, (iv) a second pinion gear connected to said first and second gear stages, (v) a third pinion gear connected to said second and third gear stages, wherein said first pinion gear drives said first planetary gear, said first planetary gear drives said second pinion gear, said second pinion gear drives said second planetary gear, said second planetary gear drives said third pinion gear, said third pinion gear drives said stationary gear, said stationary gear drives said cylindrical ring gear, and said cylindrical ring gear driving said rotation of said nozzle, and wherein the apparatus has a maximum outside dimension, said dimension being less than about 3 inches, whereby said apparatus can enter an opening having a diameter of about 3 inches.

21. An apparatus for cleaning the interior of a vessel by ejecting a rotating stream of pressurized fluid comprising:

an inlet for receiving said fluid under pressure;

a nozzle having a passage for ejecting said pressurized fluid received by said inlet said nozzle mounted for rotation about a central axis;

an impeller driven by said pressurized fluid and connected to an input shaft, said input shaft mounted for rotation about said central axis;

an input pinion gear connected to said input shaft and mounted for rotation about said central axis;

a first gear train driven by said input pinion gear, said first gear train including at least one planetary gear, said planetary gear defining a second axis about which said planetary gear rotates, said second axis displaced from said central axis, said planetary gear mounted so that rotation of said planetary gear causes rotation of said second axis about said central axis;

a first ring gear mounted for rotation about said central axis, said first ring gear driven by said first gear train, said planetary gear engaging and rotating within said first ring gear;

an output pinion gear mounted for rotation about said central axis, said output pinion gear driven by said first ring gear;

a second ring gear mounted for rotation about said central axis, said second ring gear driven by said output pinion gear and driving rotation of said nozzle about said central axis, and wherein the apparatus has a maximum outside dimension, said dimension being less than about 3 inches, whereby said apparatus can enter an opening having a diameter of about 3 inches.

22. The apparatus according to claim 21, wherein said first gear train further comprises a stationary gear driven by said planetary gear, said stationary gear rotating within said first ring gear about a third axis, said third axis displaced from said central axis.

23. The apparatus according to claim 21, wherein said input shaft extends through said output pinion gear.

24. The apparatus according to claim 21, wherein said nozzle is also mounted for rotation about a third axis, and further comprising a second gear train driving rotation of said nozzle about said third axis, said second gear train driven by said second ring gear, said output pinion gear and said second ring gear being located between said first and second gear trains.

* * * * *

UNITED STATES PATENT AND TRADEMARK OFFICE

CERTIFICATE OF CORRECTION

PATENT NO. : 5,954,271
DATED : September 21, 1999
INVENTOR(S) : Le

It is certified that error appears in the above-indentified patent and that said Letters Patent is hereby corrected as shown below:

Cover Page, in "[73] Assignee:" delete "Gamajer" and insert --Gamajet-- therefor.
Column1, line 9, delete "nozzles" and insert --nozzle-- therefor.
Column 2, line 16, delete "a too" and insert --at too-- therefor.
Column 4, line 5, delete "derive" and insert --drive-- therefor.
Column 4, line 61, delete second occurrence of the words "to rotation".
Column 5, line 67, delete "50-450 psi" and insert --50-600 psi-- therefor.
Column 6, line 27, delete "he present" and insert --the present-- therefor.
Column 6, line 37, delete "an small" and insert --a small-- therefor.

Signed and Sealed this

Fifteenth Day of May, 2001

Nicholas P. Godici

*Attest:*

NICHOLAS P. GODICI

*Attesting Officer*

*Acting Director of the United States Patent and Trademark Office*